US005348309A

United States Patent [19]

Queiros

[11] Patent Number: 5,348,309

[45] Date of Patent: Sep. 20, 1994

[54] SPORT NET

[76] Inventor: Robert E. Queiros, 21 South St. Apt. 31, Westboro, Mass. 01581

[21] Appl. No.: 110,016

[22] Filed: Aug. 23, 1993

[51] Int. Cl.[5] ..... A63B 61/00

[52] U.S. Cl. ..... 273/411; 273/29 B; 273/DIG. 26

[58] Field of Search ..... 273/411, 29 B, DIG. 26

[56] References Cited

U.S. PATENT DOCUMENTS

| | | | |
|---|---|---|---|
| 3,968,968 | 7/1976 | Peterson | 273/411 |
| 4,398,724 | 8/1983 | Wilson et al. | 273/411 |
| 4,831,956 | 5/1989 | Thater | 273/DIG. 26 |
| 5,058,899 | 10/1991 | Jackson et al. | 273/411 |

*Primary Examiner*—William H. Grieb

[57] ABSTRACT

A new and improved sport net includes a net assembly which includes two long sides, a first short side, and a second short side. A first sleeve member is connected to the first short side of the net assembly, and a second sleeve member is connected to the second short side of the net assembly. The first sleeve member and the second sleeve member are capable of slipping over a top portion of respective support poles. A first ear assembly is connected to the first sleeve member. The first ear assembly includes a flap portion and a first aperture located within the flap portion, and a second ear assembly is connected to the second sleeve member. The second ear assembly includes a flap portion and a second aperture located with the flap portion, such that guy wires can be passed through the respective first aperture and the second aperture for reinforcing the stability of the poles and the apparatus attached to the poles. A score keeping assembly, which includes a plurality of markers for indicating respective scores of respective players, may be connected to the net assembly. A sensor/signalling assembly, including a trip wire attached to the first sleeve member and the second sleeve member, may be used for sensing and signalling when the net assembly is hit. When the trip wire is tripped after the net assembly is hit, a visible or an audible signal of the hit is provided.

8 Claims, 4 Drawing Sheets

SPORT NET

BACKGROUND OF THE INVENTION

1. Field of the Invention

The present invention relates generally to nets, and, more particularly, to nets used in sports such as volleyball and badminton.

2. Description of the Prior Art

A number or sports or games require the presence of an elevated net extending across the width of a playing court. Such sports include volleyball and badminton. Supports for conventional nets for such sports are generally stiff poles that are driven into the ground. Conventional nets generally employ strings to tie respective corners of the nets to the poles.

The use of strings to tie nets to poles presents a number of problems. One problem relates to the formation of knots. It is often difficult to repetitively tie strings onto poles without forming undesired knots. In this respect, it would be desirable if a sport net were provided which precludes the problem of knots forming in strings used to tie a net to support poles.

Another problem relating to the use of strings for tying a sport net to a support pole relates to the fact that a net has four corners, and four knots must be tied to secure the net to the pole. With such a conventional net, not only must four knots be tied to install the net, but four knots must be untied to disassemble the net when the game is over. In this respect, it would be desirable if a sport net were provided which precludes the necessity of tying four knots to assemble a net on support poles and precludes the necessity of untying four knots when the net is disassembled.

Strings that support nets on poles are generally secured to the nets by a relatively few stitches. Such few stitches undergo quite a bit of stress and strain when the strings are in use. As a consequence, such few stitches tend to prematurely break under the stress and strain making it difficult to secure the net to the respective poles properly. In this respect, it would be desirable if a sport net were provided which is not supported by strings that have a relatively few stitches that tend to wear prematurely.

Sport nets erected on poles should ideally be quite taut to serve their purposes. Often, however, it is difficult to maintain tautness of a net when the net is supported on the poles only at its four corners. In this respect, it would be desirable if a sport net were provided which is easy to keep taut.

When a sport net is erected on poles, it is often necessary or desirable to support the poles with guy wires and the like. Attaching guy wires to conventional poles may be a difficult task. In this respect, it would be desirable if a sport net were provided which makes it easy to attach guy wires for supporting the poles.

When conventional nets are supported on conventional poles by four sets of strings attached to respective corners of the nets, the nets may tend to exhibit a curled, as opposed to flat, appearance. The curled appearance may be due to the fact that it is very difficult to retain two dimensional tautness of the net with the four corners tied to the poles. More specifically, two corners on one pole must be taut with respect to the vertical dimension along the pole; and, in addition, opposing corners, on opposite poles must also be maintained in a taut condition. In actuality, such two dimensional tautness is difficult to maintain with four corners of the net. In this respect, it would be desirable if a sport net were provided which facilitates maintaining the net so that it has a flat, not curled, appearance.

In all sports, scores must be recorded, and players are often kept up to date as to the current score. Often the score is kept on a scoreboard. Generally, either one or both players must look away from the game court to see the scoreboard. Glancing away from the playing court at an inappropriate time may be a blunder in a closely fought game. In this respect, it would be desirable if a sport net were provided which enables a player to see the current score without looking away from the playing court.

In net games such as volleyball and badminton, when a net is hit is often a significant occurrence in the game. Hitting a net can often have great consequences in the score of the game. Sometimes a gentle hit of the net may not be perceived equally by both sides. Often heated disputes take place as to whether the net was hit or not. In this respect, it would be desirable if a sport net were provided which includes a device for sensing and signalling when the net is hit during the game.

Throughout the years, a number of innovations have been developed relating to supports for nets used in sports, and the following U.S. patents are representative of some of those innovations: U.S. Pat. No. 3,758,116; U.S. Pat. No. 4,083,561; U.S. Pat. No. 4,809,988; U.S. Pat. No. 5,000,461; and U.S. Pat. No. 5,080,375. None of these patents, however, relate to the type of net that is erected and used in the sports of volleyball and badminton.

Thus, while the foregoing body of prior art indicates it to be well known to use sport nets supported on poles, the prior art described above does not teach or suggest a sport net which has the following combination of desirable features: (1) precludes the problem of knots forming in strings used to tie a net to support poles; (2) precludes the necessity of tying four knots to assemble a net on support poles and precludes the necessity of untying four knots when the net is disassembled; (3) is not supported by strings that have a relatively few stitches that tend to wear prematurely; (4) is easy to keep taut; (5) makes it easy to attach guy wires for supporting the poles; (6) facilitates maintaining the net so that it has a flat, not curled, appearance; (7) enables a player to see the current score without looking away from the playing court; and (8) includes a device for sensing and signalling when the net is hit during the game. The foregoing desired characteristics are provided by the unique sport net of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved sport net which includes a net assembly which includes two long sides, a first short side, and a second short side. A first sleeve member is connected to the first short side of the net assembly, and a second sleeve member is connected to the second short side of the net assembly. The first sleeve member and the second sleeve member are capable of slipping over a top portion of respective support poles.

A first ear assembly is connected to the first sleeve member. The first ear assembly includes a flap portion and a first aperture located within the flap portion, and a second ear assembly is connected to the second sleeve member. The second ear assembly includes a flap portion and a second aperture located with the flap portion, such that guy wires can be passed through the respective first aperture and the second aperture for reinforcing the stability of the poles and the apparatus attached to the poles.

A score keeping assembly may be connected to the net assembly. The score keeping assembly includes a first support element attached to the net assembly near the first short side. A second support element is attached to the net assembly near the second short side. A marker support cable is connected between the first support element and the second support element, and a plurality of markers are supported on the marker support cable. The markers are capable of being slidingly displaced along the marker support cable, such that one grouping of markers represents a score of one player, and another grouping of markers represents a score of another player.

A sensor/signalling assembly, attached to the first sleeve member and the second sleeve member, may be used for sensing and signalling when the net assembly is hit.

The sensor/signalling assembly includes a trip wire that is connected at one end to a first trip wire support member. The first trip wire support member is connected to the first sleeve member. The second trip wire support member is capable of being in a first position, an untripped position, and in a second position, a tripped position.

An electrical signalling assembly is responsive to a tripped position of the second trip wire support member. The electrical signalling assembly includes a switch responsive to a tripped position of the second trip wire support member. A first terminal of a battery power supply is connected to a first terminal of the switch, and a second terminal of the battery power supply is connected to a first terminal of a signal provider, wherein a second terminal of the signal provider is connected to a second terminal of the switch. The signal provider may be an electric lamp, a sound producer, or both. When the trip wire is tripped after the net assembly is hit, a visible or an audible signal of the hit is provided.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved sport net which has all of the advantages of the prior art and none of the disadvantages.

It is another object of the present invention to provide a new and improved sport net which may be easily and efficiently manufactured and marketed.

It is a further object of the present invention to provide a new and improved sport net which is of durable and reliable construction.

An even further object of the present invention is to provide a new and improved sport net which is susceptible of a low cost of manufacture with regard to both materials and labor, and which accordingly is then susceptible of low prices of sale to the consuming public, thereby making such sport net available to the buying public.

Still yet a further object of the present invention is to provide a new and improved sport net which precludes the problem of knots forming in strings used to tie a net to support poles.

Still another object of the present invention is to provide a new and improved sport net that precludes the necessity of tying four knots to assemble a net on support poles and precludes the necessity of untying four knots when the net is disassembled.

Yet another object of the present invention is to provide a new and improved sport net which is not supported by strings that have a relatively few stitches that tend to wear prematurely.

Even another object of the present invention is to provide a new and improved sport net that is easy to keep taut.

Still a further object of the present invention is to :provide a new and improved sport net which makes it easy to attach guy wires for supporting the poles.

Yet another object of the present invention is to provide a new and improved sport net that facilitates maintaining the net so that it has a flat, not curled, appearance.

Still another object of the present invention is to provide a new and improved sport net which enables a player to see the current score without looking away from the playing court.

Yet another object of the present invention is to provide a new and improved sport net that includes a device for sensing and signalling when the net is hit during the game.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
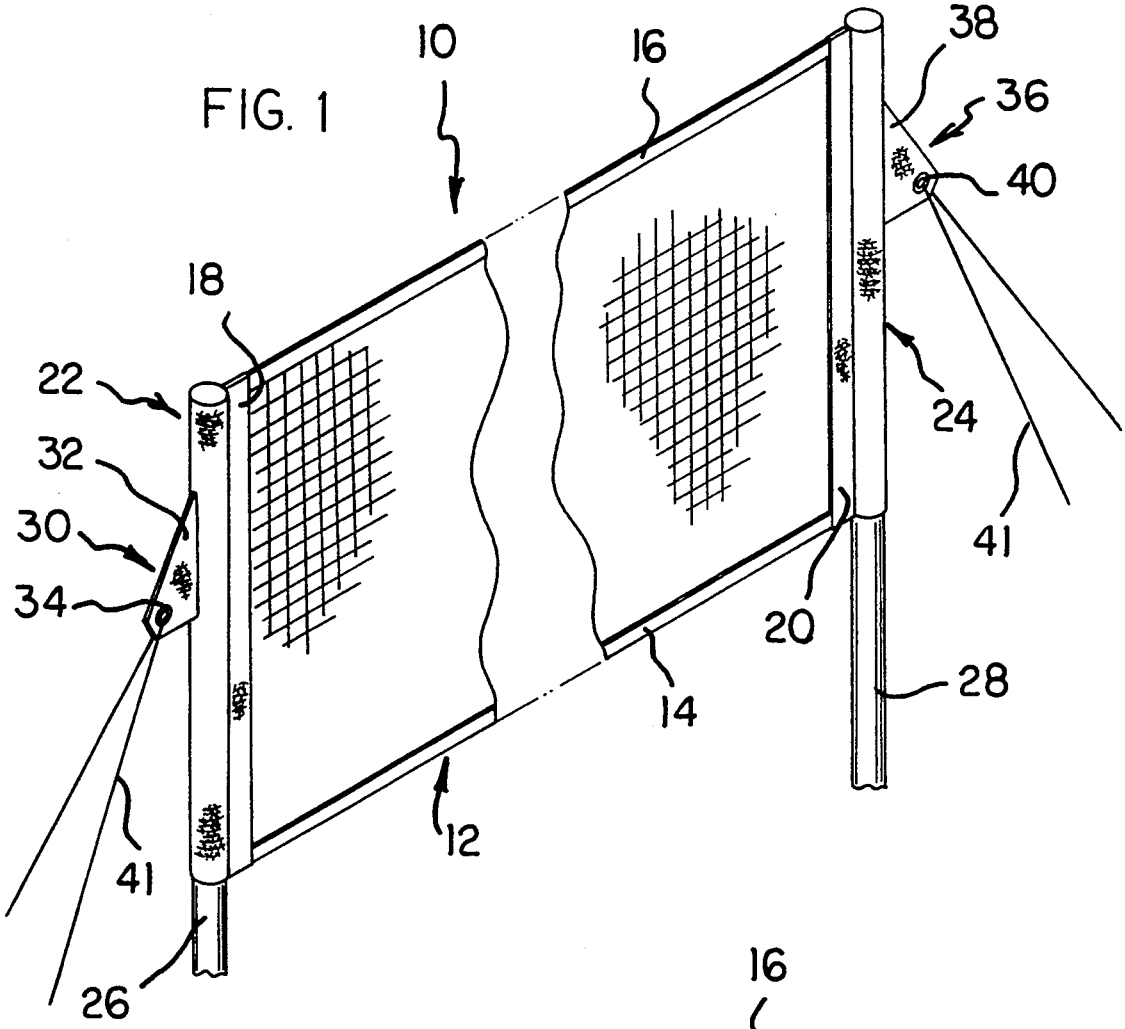
FIG. 1 is a perspective view showing a first preferred embodiment of the sport net of the invention.
Figure 2:
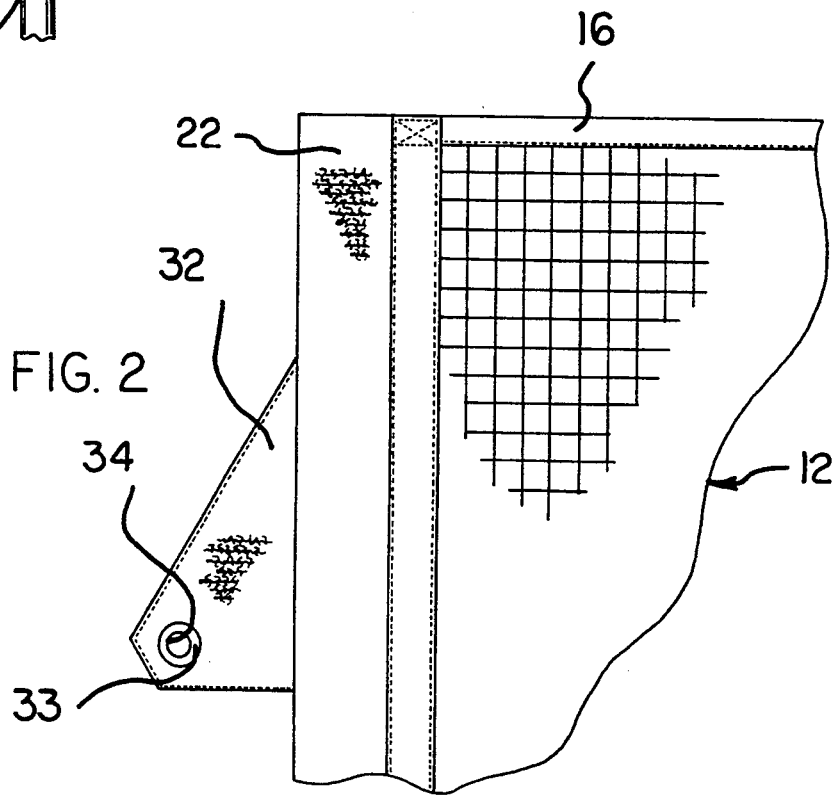
FIG. 2 is an enlarged front view of a top corner portion of the embodiment of the invention shown in FIG. 1.
Figure 3:
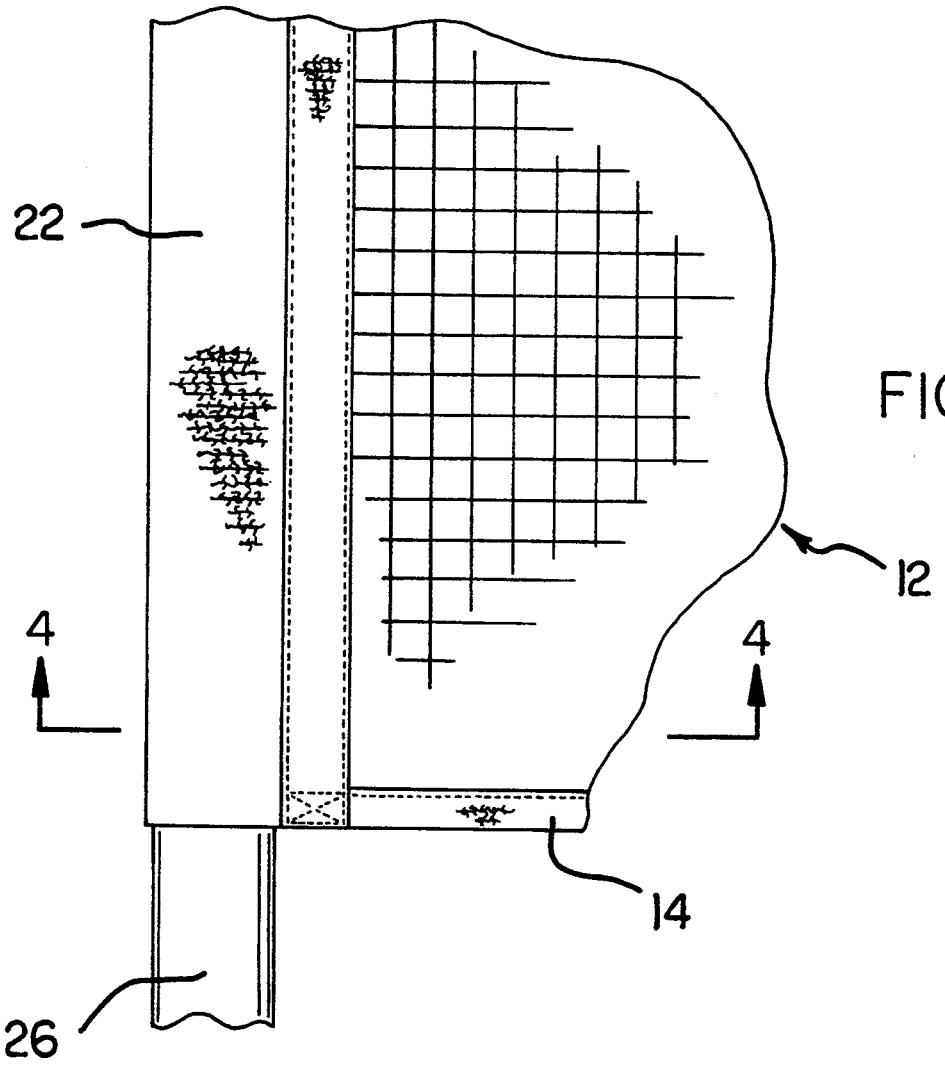
FIG. 3 is an enlarged front view of a bottom corner portion of the embodiment of the invention shown in FIG. 1.
Figure 4:
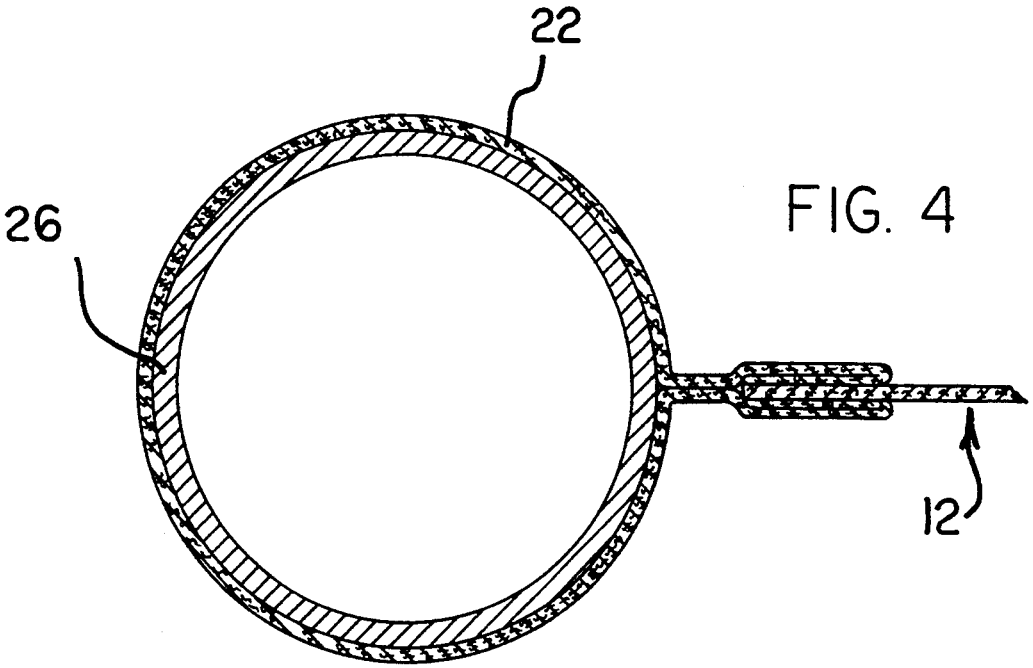
FIG. 4 is an enlarged cross-sectional view of the embodiment of the invention shown in FIG. 3 taken along line 4—4 of FIG. 3.

With reference to the drawings, a new and improved sport net embodying the principles and concepts of the present invention will be described.

Turning initially to FIGS. 1–4, there is shown a first exemplary embodiment of the sport net of the invention generally designated by reference numeral 10. In its preferred form, sport net 10 includes two long sides 14 and 16, a first short side 18, and a second short side 20. A first sleeve member 22, cylindrical in shape, is connected to the first short side 18 of the net assembly 12, and a second sleeve member 24, cylindrical in shape, is connected to the second short side 20 of the net assembly 12. The first sleeve member 22 and the second sleeve member 24 are capable of slipping over a top portion of respective support poles 26 and 28.

In use, support poles 26 and 28 are placed in the ground at predetermined locations. Then the respective first sleeve member 22 and second sleeve member 24 are slid over the support poles 26 and 28, respectively.

A first ear assembly 30 is connected to the first sleeve member 22 by sewn stitches connecting the first ear assembly 30 to the first sleeve member 22. The first ear assembly 30 includes a flap portion 32 and a first aperture 34 located within the flap portion 32, and a second ear assembly 36 is connected to the second sleeve member 24. The second ear assembly 36 includes a flap portion 38 and a second aperture 40 located with the flap portion 38, such that guy wires 41 or ropes or the like can be passed through the respective first aperture 34 and the second aperture 40 for reinforcing the stability of the poles 26 and 28 and the apparatus attached to the poles 26 and 28. The first aperture 34 and the second aperture 40 are reinforced by metal eyelets 33.

Figure 5:
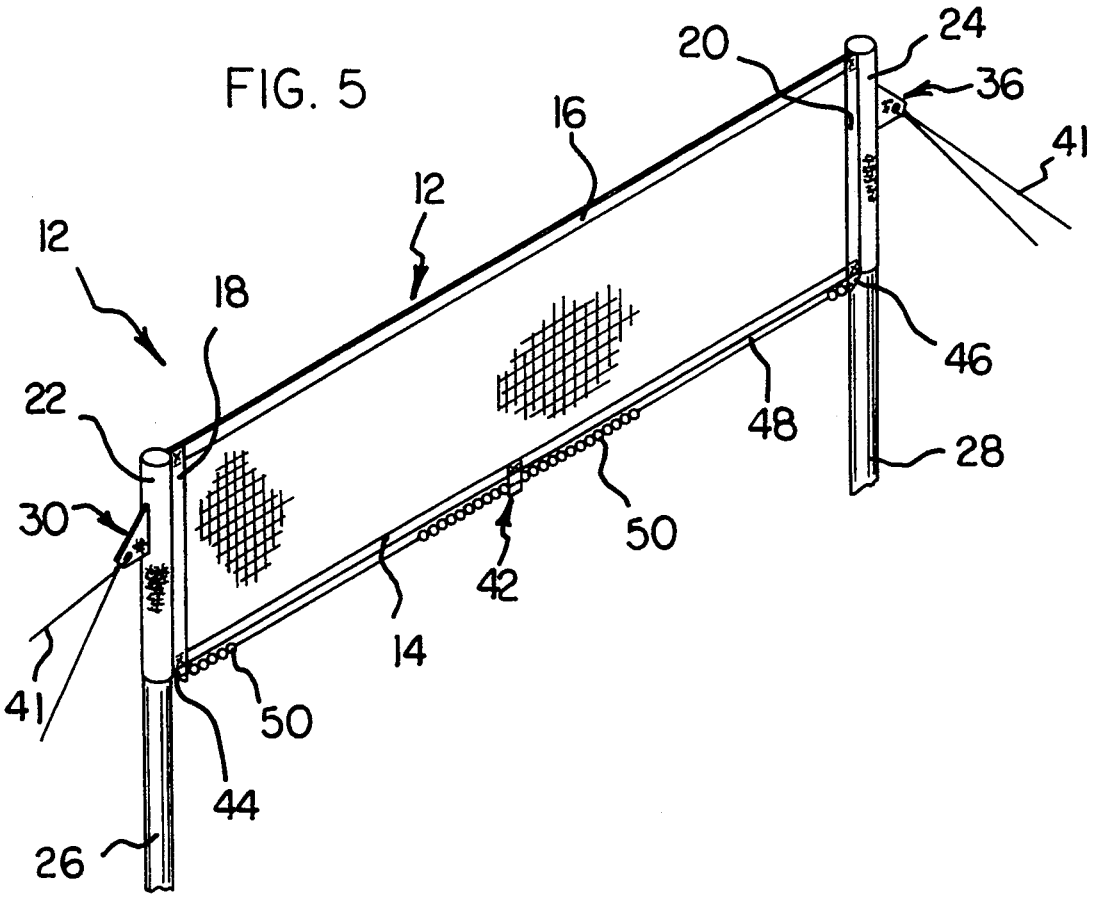
FIG. 5 is a perspective view of a second preferred embodiment of the invention which includes a device for keeping score attached to the net.
Figure 6:
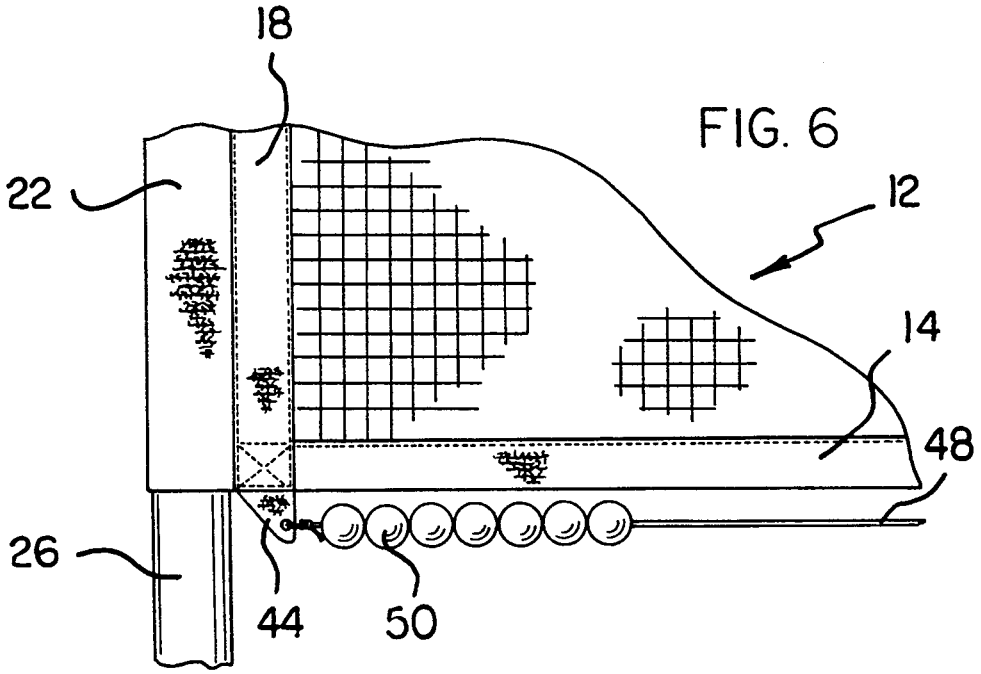
FIG. 6 is an enlarged side view of a bottom corner of the embodiment of the invention shown in FIG. 5.

Turning to FIGS. 5–6, a second embodiment of the invention is shown. Reference numerals are shown that correspond to like reference numerals that designate like elements shown in the other figures. In addition, a score keeping assembly 42 is connected to the net assembly 12. The score keeping assembly 42 includes a first support element 44 attached to the net assembly 12 near the first short side 18. A second support element 46 is attached to the net assembly 12 near the second short side 20. A marker support cable 48 is connected between the first support element 44 and the second support element 46, and a plurality of markers 50 are supported on the marker support cable 48. The markers 50 are capable of being slidingly displaced along the marker support cable 48, such that one grouping of markers 50 represents a score of one player, and another grouping of markers 50 represents a score of another player.

The markers 50 are comprised of spheres which includes diametrical channels therein. The marker support cable 48 is threaded through the respective channels in the spheres. A clearance exists between the channels and the marker support cable 48 so that the markers 50 can be easily slidingly displaced along the marker support cable 48 as the score changes. The respective first support element 44 and second support element 46 includes apertures for receiving the marker support cable 48 so that respective knots can be formed in the marker support cable 48 to securely fix the marker support cable 48 to the respective support elements 44 and 46.

Figure 7:
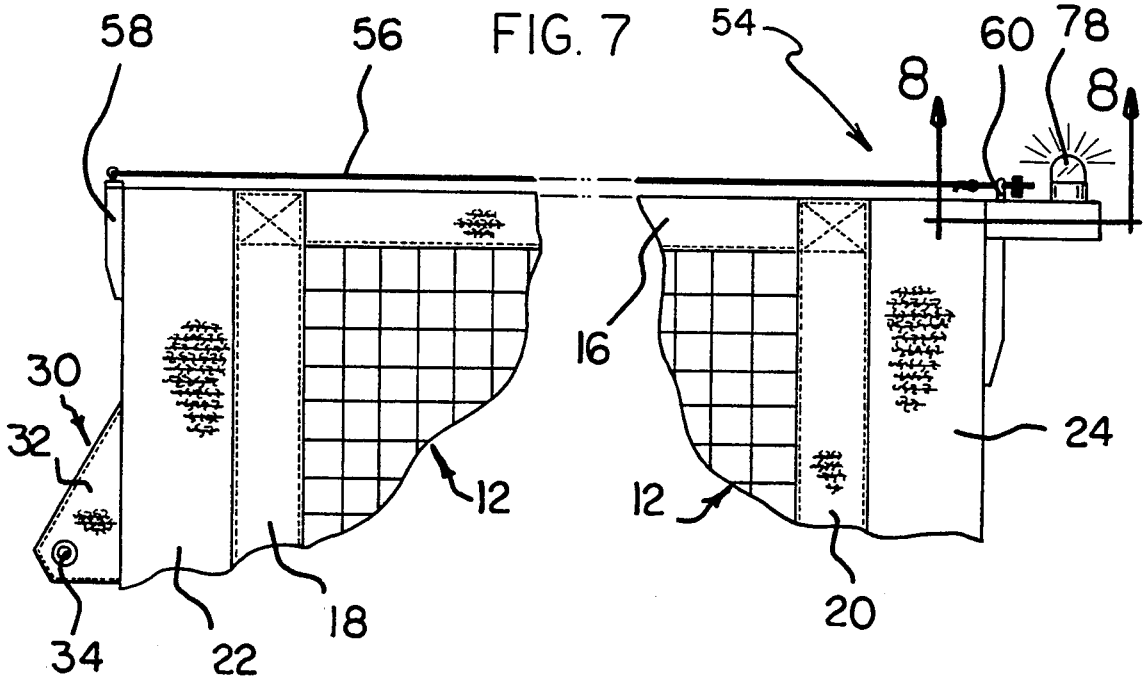
FIG. 7 a partial side view of a third embodiment of the sport net of the invention which includes a device for sensing and providing a signal when the net is struck during play of the game.
Figure 8:
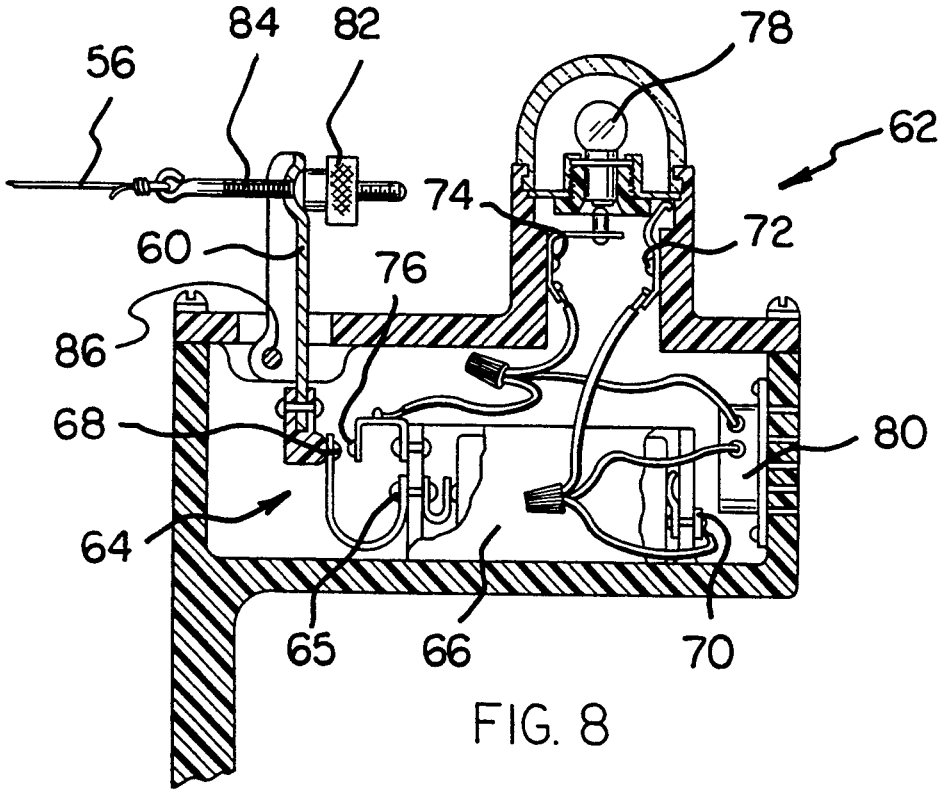
FIG. 8 is an enlarged, cross-sectional view of the embodiment shown in FIG. 7 taken along line 8—8 in FIG. 7.

Turning to FIGS. 7–8, a third embodiment of the invention is shown. Reference numerals are shown that correspond to like reference numerals that designate like elements shown in the other figures. In addition, a sensor/signalling assembly 54, attached to the first sleeve member 22 and the second sleeve member 24, is used for sensing and signalling when the net assembly 12 is hit. The sensor/signalling assembly 54 is used to sense and signal when the net assembly 12 is hit either by a projectile, such as a volleyball or badminton birdie, or by a hand or other body part of a player.

The sensor/signalling assembly 54 includes a trip wire 56 that is connected at one end to a first trip wire support member 58. The first trip wire support member 58 is connected to the first sleeve member 22. The trip wire 56 is connected at another end to a second trip wire support member 60. The second trip wire support member 60 is capable of being in a first position, an untripped position, and in a second position, a tripped position.

An electrical signalling assembly 62 is responsive to a tripped position of the second trip wire support member 60. The electrical signalling assembly 62 includes a switch 64 responsive to a tripped position of the second trip wire support member 60. A first terminal 65 of a battery power supply 66 is connected to a first terminal 68 of the switch 64, and a second terminal 70 of the battery power supply 66 is connected to a first terminal 72 of a signal provider, wherein a second terminal 74 of the signal provider is connected to a second terminal 76 of the switch 64. The signal provider may be an electric lamp 78, a sound producer 80, or both.

In using the sensor/signalling assembly 54, the trip wire 56 is brought to an initial tension, an untripped tension, using threaded nut 82 that is connected to threaded bolt 84 which is connected to the trip wire 56. In the untripped condition, the first terminal 68 and the second terminal 76 of the switch 64 are open. When the net assembly 12 is hit, either by a projectile or a person, additional tension is applied to the trip wire 56. With the additional tension, the second trip wire support member 60 pivots around the pivot pin 86 whereby the first terminal 68 and the second terminal 76 of the switch 64 form a closed circuit, whereby the light signaling lamp 78 and the sound producer 80 provide visual and audible signals of the hit on the net assembly 12, respectively.

The components of the sport net of the invention can be made from inexpensive and durable cloth and plastic materials. The sleeve members may be made from nylon material. The net assembly 12 can be connected to the respective sleeve members by sewn stitches along the length of the respective first short sides 18 and 20.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved sport net that is low in cost, relatively simple in design and operation, and which may advantageously be used to preclude the problem of knots forming in strings used to tie a net to support poles. With the invention, a sport net is provided which precludes the necessity of tying four knots to assemble a net on support poles and precludes the necessity of untying four knots when the .net is disassembled. With the invention, a sport net is provided which is not supported by strings that have a relatively few stitches that tend to wear prematurely. With the invention, a sport net is provided which is easy to keep taut. With the invention, a sport net is provided which makes it easy to attach guy wires for supporting the poles. With the invention, a sport net is provided which facilitates maintaining the net so that it has a flat, not curled, appearance. With the invention, a sport net is provided which enables a player to see the current score without looking away from the playing court. With the invention, a sport net is provided which includes a device for sensing and signalling when the net is hit during the game.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved sport net, comprising:

a net assembly which includes two long sides, a first short side, and a second short side, a first sleeve member connected to said first short side of said net assembly, and a second sleeve member connected to said second short side of said net assembly, wherein said first sleeve member and said second sleeve member are capable of slipping over a top portion of respective support poles, further including:

a first ear assembly connected to said first sleeve member, said first ear assembly including a flap portion and a first aperture located within said flap portion, and a second ear assembly connected to said second sleeve member, said second ear assembly including a flap portion and a second aperture located with said flap portion, such that guy wires can be passed through said respective first aperture and said second aperture for reinforcing stability of the poles supporting said apparatus.

2. The apparatus described in claim 1, further including:

a sensor/signalling assembly, attached to said first sleeve member and said second sleeve member, for sensing and signalling when said net assembly is hit.

3. The apparatus described in claim 2 wherein said sensor/signalling assembly includes:

a trip wire connected at one end to a first trip wire support member, said first trip wire support member connected to said first sleeve member, said trip wire connected at another end to a second trip wire support member, wherein said second trip wire support member is capable of being in a first position, an untripped position, and in a second position, a tripped position, and an electrical signalling assembly responsive to a tripped position of said second trip wire support member.

4. The apparatus described in claim 3 wherein said electrical signalling assembly includes:

a switch responsive to a tripped position of said second trip wire support member, a first terminal of a battery power supply connected to a first terminal of said switch, and a second terminal of said battery power supply connected to a first terminal of a signal provider, wherein a second terminal of said signal provider is connected to a second terminal of said switch.

5. The apparatus described in claim 4 wherein said signal provider is an electric lamp.

6. The apparatus described in claim 4 wherein said signal provider is a sound producer.

7. A new and improved sport net, comprising:

a net assembly which includes two long sides, a first short side, and a second short side, a first sleeve member connected to said first short side of said net assembly, and a second sleeve member connected to said second short side of said net assembly, wherein said first sleeve member and said second sleeve member are capable of slipping over a top portion of respective support poles, further including:

a score keeping assembly connected to said net assembly, wherein said score keeping assembly includes:

a first support element attached to said net assembly near said first short side, a second support element attached to said net assembly near said second short side, a marker support cable connected between said first support element and said second support element, and a plurality of markers supported on said marker support cable.

8. The apparatus described in claim 7 wherein said markers are capable of being slidingly displaced along said marker support cable, such that one grouping of markers represents a score of one player, and another grouping of markers represents a score or another player.

* * * * *